United States Patent [19]

Hurworth

[11] Patent Number: 4,953,625

[45] Date of Patent: Sep. 4, 1990

[54] ADJUSTABLE, PIVOTABLE BLADE FOR BULLDOZERS AND THE LIKE

[75] Inventor: Samuel G. Hurworth, Port Angeles, Wash.

[73] Assignee: Delhur Industries, Inc., Port Angeles, Wash.

[21] Appl. No.: 329,444

[22] Filed: Mar. 28, 1989

[51] Int. Cl.[5] ..... E02F 3/815

[52] U.S. Cl. ..... 172/305; 172/307; 172/459; 172/484

[58] Field of Search ..... 172/815, 786, 784, 459, 172/460, 297, 305, 307; 37/281, 105

[56] References Cited

U.S. PATENT DOCUMENTS

| | | | |
|---|---|---|---|
| 2,312,255 | 2/1943 | Lowdermilk | 172/305 X |
| 2,961,054 | 11/1960 | Green | 172/305 |
| 3,049,822 | 8/1962 | McMullen | 172/459 X |
| 3,061,956 | 11/1962 | Braden | 172/459 X |
| 3,226,860 | 1/1966 | McGee | 172/817 |
| 3,720,010 | 3/1973 | Coates | 172/786 X |
| 3,726,347 | 4/1973 | Hyman | 37/105 |
| 4,357,766 | 11/1982 | Croteau | 37/281 |
| 4,579,178 | 4/1986 | Dover | 172/459 |
| 4,798,011 | 1/1989 | Sprinkle | 172/459 |
| 4,821,810 | 4/1989 | Buchanan | 172/445.2 |

*Primary Examiner*—Richard J. Johnson

*Attorney, Agent, or Firm*—Graybeal, Jensen & Puntigam

[57] ABSTRACT

The adjustable blade apparatus (10) is adapted for use with an earth moving vehicle (12). It includes a support frame (20) which is pivotable in the vertical plane relative to the vehicle (12). A blade assembly (22) is rotatably secured to a connecting frame portion (54) of the support frame (20) by means of a turntable (26) and a swivel connection (27). The blade assembly (22) is moved relative to connecting frame (54) by hydraulic cylinders (28,30).

9 Claims, 4 Drawing Sheets

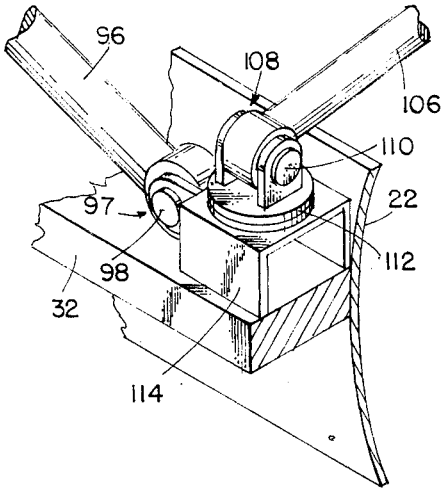
FIG. 5
FIG. 6
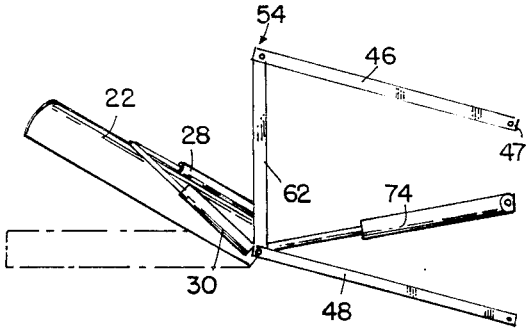
FIG. 7
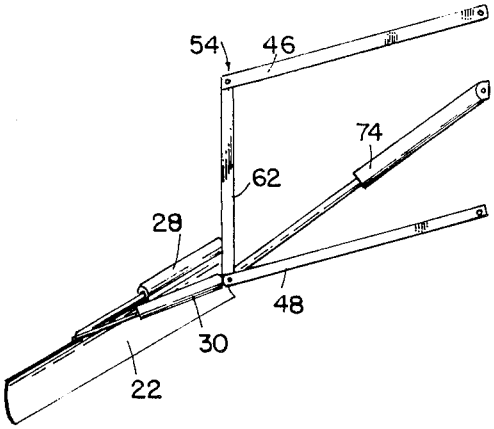

ADJUSTABLE, PIVOTABLE BLADE FOR BULLDOZERS AND THE LIKE

TECHNICAL FIELD

This invention relates generally to large earth moving vehicles and related accessories therefor, and more specifically concerns an attachment blade which is adapted for use with a bulldozer or similar earth moving vehicle.

BACKGROUND ART

Large scale earth moving and/or grading operations, such as cutting and cleaning ditches or trenches, are typically accomplished by large vehicles, such as a tracked vehicle such as a bulldozer, or a wheeled vehicle like a grader. Typically, each of those vehicles has an earth moving blade which is capable of a certain range of movement. For instance, the bulldozer has a front blade which is capable of vertical movement for cutting and grading operations directly in front of the vehicle. The grader, on the other hand, has a blade located beneath the carriage of the vehicle which may be oriented at particular angles but which may not be raised or lowered vertically to any substantial extent. Such a blade accomplishes certain cutting and grading operations beneath the vehicle.

With these conventional blades, however, it is not possible to do cutting or cleaning along a vertical side of a trench adjacent the vehicle, or to do grading above or below the vehicle. Also it is not possible to cut a ditch along side the vehicle. Hence, conventional blades are rather limited in their application.

Certain special purpose attachment blades are known, however, which provide increased capability for such vehicles. One blade in particular which is in use attached to the front side of a bulldozer is referred to as a slope board. With the slope board, the blade may be positioned at a selected angle in a plane transverse to the vehicle and may also be moved to a selected position in a longitudinal plane relative to the vehicle. The slope board attachment permits a bulldozer to clean and cut the sides of a trench in which the vehicle is moving. However, such a blade cannot be used for cutting or cleaning below the vehicle, and is also limited in its upward reach. Furthermore, some functions such as finishing off a ditch, and cutting a ditch under adverse weather conditions are not possible with the slope board. The dirt removed by the blade also falls beneath the vehicle, which is disadvantageous. Still further, the use of the slope board on a bulldozer limits the effectiveness of the front blade because of the front end weight and side loading added by the slope board and the increase in the effective overall width of the vehicle. Thus, the use of the slope board limits the total capability of the vehicle.

Other specialized accessory blades for particular purposes are also known, some of which are adapted specifically for use with a tracked vehicle such as a bulldozer and others for a wheeled vehicle such as a grader.

However, there is no known bulldozer or grader blade which will permit the use of a vehicle like a bulldozer (for instance) in its conventional configuration, while providing the increased capability of performing a multitude of cutting, cleaning and grading functions, including operations on ground above and below the vehicle. It is desirable to have a single blade attachment which may be moved into a wide variety of positions relative to the bulldozer and which has a reach which extends both above and below the vehicle itself and a range of angles in both the horizontal and vertical planes relative to the vehicle.

DISCLOSURE OF THE INVENTION

Accordingly, the present invention is an adjustable blade apparatus for use with an earth moving vehicle, such as a bulldozer or the like. The apparatus includes a support frame, which is securable to the vehicle, a blade for moving earth, the blade being movably secured to the support frame, means for moving the blade in a first plane relative to the support frame, and means for moving the blade in a second plane relative to the support frame, the second plane being at a substantial angle relative to said first plane.

BRIEF DESCRIPTION OF THE DRAWINGS

FIG. 5 is an enlarged perspective view showing a still further portion of the apparatus of FIG. 2.

FIG. 6 is a side elevational view showing one operating position of the apparatus of FIG. 2.

FIG. 7 is a side elevational view showing another operating position for the apparatus of FIG. 2.

BEST MODE FOR CARRYING OUT THE INVENTION

Figure 1:
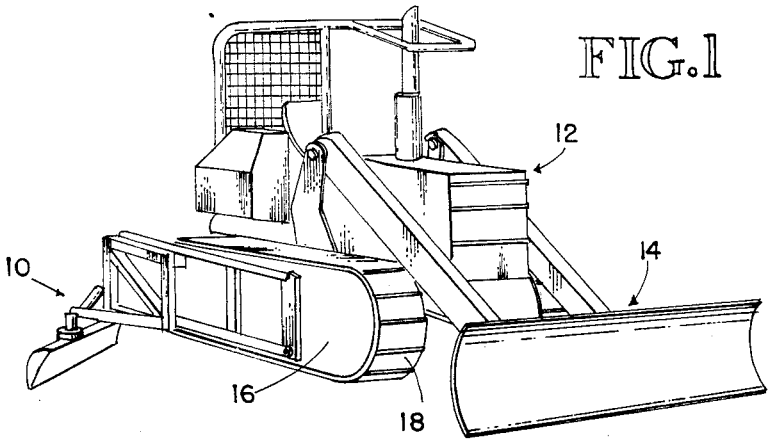
FIG. 1 is a perspective view of a tracked loader vehicle with the adjustable blade apparatus of the present invention attached thereto.

FIG. 1 shows the adjustable blade apparatus of the present invention, referred to generally at 10, secured to a conventional tracked loader vehicle 12. The vehicle 12 has a conventional front scraper blade 14. In FIG. 1, the adjustable blade apparatus 10 is shown secured to the one side of the vehicle 12 in a position 16 which is bounded by one of the tracks 18. The adjustable blade apparatus 10 may be secured to either side of the vehicle 12.

Figure 2:
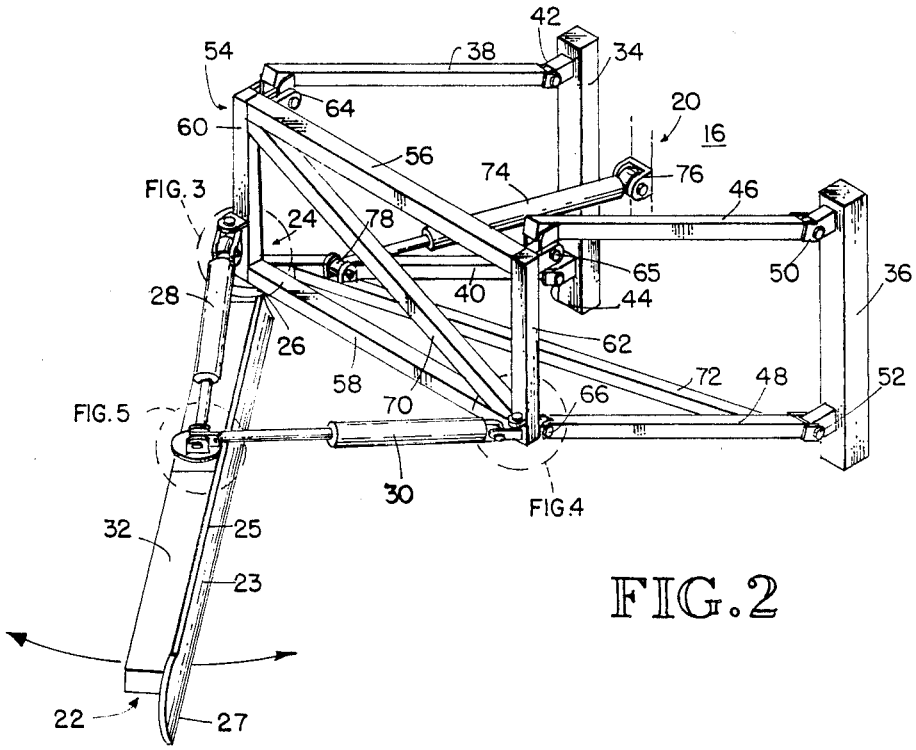
FIG. 2 is a perspective view of the adjustable blade apparatus of the present invention, including the support frame therefore.

FIG. 2 shows the adjustable blade apparatus 10 in more detail. The apparatus 10 comprises a support frame shown generally at 20 and an elongated earth moving blade assembly shown generally at 22. The blade assembly 22 is rotatably secured to a lower forward corner 24 of support frame 20 by means of a turntable element 26 and pivot connector 27 (not shown in FIG. 2). The turntable assembly 26 and pivot connector 27 are shown in more detail in FIG. 3 and will be explained in more detail hereinafter. The movement of the blade assembly 22 about turntable 26 and pivot connection 27 is controlled by two hydraulic cylinders 28 and 30, which in combination provide the blade assembly 22 the desired full range of movement relative to support frame 20 and hence the vehicle 12.

In the embodiment shown, blade assembly 22 includes a blade 23 which is approximately 8 feet long by 2 feet high, and is slightly concave from its top edge 25 to its lower edge 27. Extending from and secured to the rear surface of the blade 23 is a reinforcing bar 32 which maintains the structural integrity and strength of blade 23 and provides a place for secure attachment of one end of each hydraulic cylinder 28, 30.

FIG. 2 shows the entire support frame 20 of the present invention. Support frame 20 generally comprises a series of rigid struts which are connected to each other by swivel joints/connections to provide a swiveling or pivoting capability for the support frame, and hence the attached blade assembly, relative to the earth moving vehicle. The support frame 20 shown in FIG. 2 includes two vertical support struts 34 and 36. Support struts 34, 36 are approximately 26 inches long and 3 inches square in cross-section. Support struts 34, 36 are secured to the side of the vehicle 12 by conventional means such as welding or the like. In the embodiment shown, the support struts 34, 36 are positioned approximately 48 inches apart.

Extending outwardly from support strut 34 are two supporting arms 38 and 40. Supporting arms 38 and 40 extend from the vicinity of the upper and lower ends of support strut 34. Supporting arm 38 is attached to support strut 38 by a swivel connection 42 which is arranged so as to permit movement, i.e. rotation, of supporting arm 38 in the vertical plane. It would be possible, of course, that swivel connection 42 could be constructed to swivel in the horizontal plane as well, if desired. Supporting arm 40 is connected to strut 34 by a similar swivel connection 44. In the embodiment shown, supporting arms 38 and 40 are elongated steel bars, approximately 47 inches long and 3 inches square in cross-section.

Supporting arms 46 and 48, which are similar to supporting arms 38 and 40, extend outwardly from support strut 36 in the vicinity of the upper and lower ends thereof. Supporting arms 46 and 48 are connected to support strut 36 by means of swivel connections 50 and 52, respectively, which are similar to swivel connections 42 and 44.

Connected to the respective free ends of supporting arms 38, 40, 46 and 48 is a rectangular connecting frame shown generally at 54. Connecting frame 54 comprises upper and lower horizontal frame members 56 and 58 which are connected by vertical side frame members 60 and 62. A diagonal frame member 70 completes the connecting frame 54. In the embodiment shown, frame members 56, 58, 60, 62 and 70 comprise elongated steel bars which are square in cross-section, approximately 3 inches on a side. The upper and lower horizontal frame members 38 and 40 are approximately 48 inches long, while vertical side members 60 and 62 are approximately 47 inches wide. Diagonal frame member 70 is approximately 57 inches long.

Connecting frame 54 is attached to supporting arms 38, 40, 46 and 48 by means of swivel connections 64, 65 and 66 and turntable assembly 26. The swivel connections 64–66 and turntable assembly 26 permit the connecting frame 54 to be swiveled or pivoted in the vertical direction relative to supporting arms 38, 40, 46 and 48. Since supporting arms 38, 40, 46 and 48 are connected to support struts 34 and 36 by swivel connections, the entire support frame 20 is readily movable vertically relative to support struts 34 and 36 and hence the vehicle 12. As indicated above, the swivel connections could be constructed to permit rotation of the support frame 20 in both the vertical and horizontal directions, if desired.

The support frame 20 further includes a diagonal brace 72 which extends from supporting arm 48 near swivel connection 52 to supporting arm 40 near turntable assembly 26. A hydraulic cylinder 74 extends between the side surface 16 of the vehicle and the diagonal brace 72 in the vicinity of the diagonal brace's connection point to supporting arm 40. Both ends of the hydraulic cylinder 74 have swivel connections 76 and 78, which each have vertical pivoting capability, such that hydraulic cylinder 74 is capable of swivel or pivoting movement in the vertical plane at both ends thereof. As mentioned above, the hydraulic cylinder 74 could be provided with a swivel capability in the horizontal direction as well so that the support frame could be moved in the horizontal direction, if desired. Hydraulic cylinder 74 is conventional in structure and operation and is approximately 31 inches long and 3.75 inches in diameter in the embodiment shown. The total reach of the hydraulic cylinder 74, from a closed position to an extended position, is approximately 13 inches.

The hydraulic cylinder, controlled by the operator of the vehicle through conventional controls, in combination with the swivel connections 76 and 78 and the swiveling support frame 20 described above, provides a capability for the entire support frame 20, including the connecting frame 54, to be moved vertically relative to the vehicle 12. In the embodiment shown, the support frame 20 can be moved through an angle of at least 80°–90° about a horizontal reference line.

Figure 3:
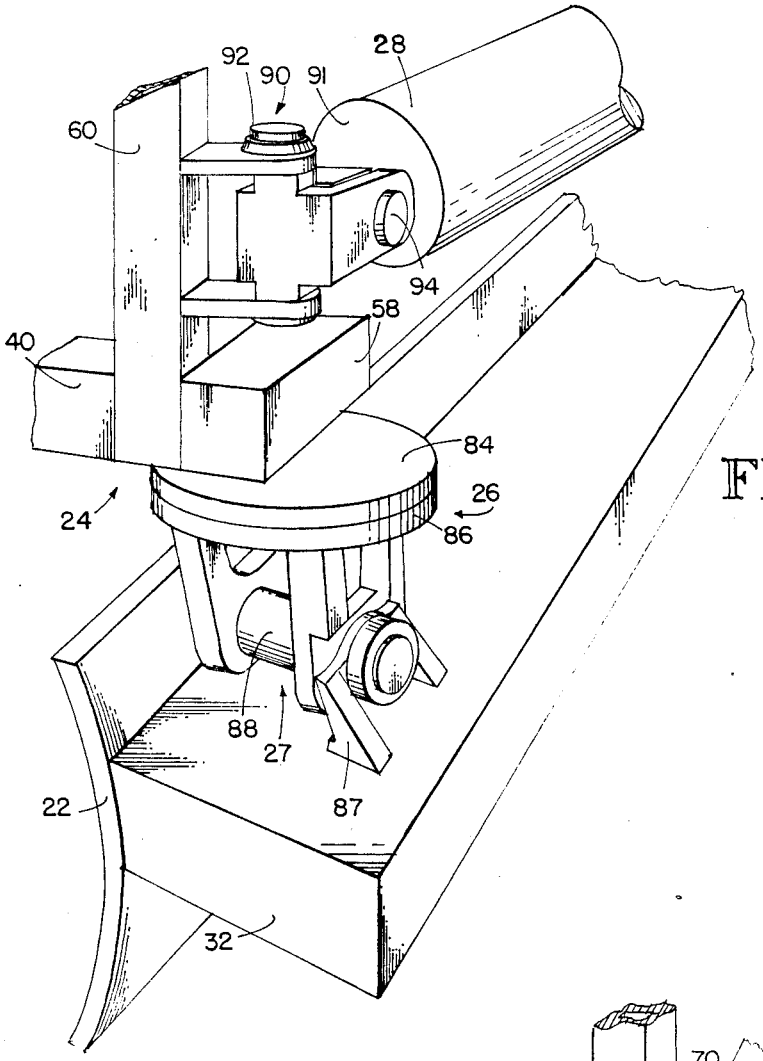
FIG. 3 is an enlarged perspective view showing one portion of the apparatus of FIG. 2 in greater detail.

The blade assembly 22, including blade 23 and supporting bar 32, is rotatably and pivotably attached to the connecting frame 54 by means of the turntable assembly 26 and pivot connector 27. This structure is shown in detail in FIG. 3. FIG. 3 shows the lower forward corner 24 of connecting frame 54, which is defined by the convergence of supporting arm 40, vertical side frame member 60 and lower horizontal frame member 58. Turntable assembly 26 comprises upper and lower circular plates 84 and 86, each plate being approximately 10 inches in diameter and 0.75 inches thick. The two circular plates 84, 86 are connected in such a manner that lower plate 86 is rotatable relative to upper circular plate 84. Upper plate 84 is secured, by means of welding or the like, to the underside of forward corner 24 of connecting frame 54.

Extending from the lower surface of lower plate 86 is pivot connector 27. The base portion 87 of pivot connector 27 is secured to the reinforcing bar 32. The bar 32 and blade 23 swivel about horizontal pivot pin 88. Turntable assembly 26 permits rotation of the blade assembly 22 in the horizontal plane, while pivot connector 27 permits rotation of the blade assembly in the vertical plane. The combination of turntable assembly 26 and pivot connector 27 provides a wide range of controlled movement of blade assembly 22 relative to support frame 20 and hence vehicle 12.

As briefly discussed above, hydraulic cylinder 28, which is partially responsible for control of the movement of the blade assembly 22, extends between the lower end of vertical side frame member 60 of connecting frame 54 and the blade assembly 22, at a point which is approximately midlength of the blade assembly. Hydraulic cylinder 28 is conventional, similar to cylinder 74. The hydraulic cylinder 28 is approximately 21 inches long, with a diameter of 3.75 inches, and has a reach of approximately 13 inches. The structural details of the connection between hydraulic cylinder 28 and vertical side frame member 60 are shown in FIG. 3, while the structural details of the connection between hydraulic cylinder 28 and blade assembly 22 are shown in FIG. 5.

Referring to FIG. 3, the rear end 91 of hydraulic cylinder 28 is secured to vertical side frame member 60 by means of a vertically oriented swivel connection 90. Swivel connection 90 permits rotation of hydraulic cylinder 28, and hence blade assembly 22, in (1) the horizontal plane about vertical swivel element or pin 92 and in (2) the vertical plane about horizontal swivel element or pin 94. Referring to FIG. 5, the forward end of extending arm 96 of hydraulic cylinder 28 connects to a swivel connection 97, which includes a horizontal swivel pin 98 for vertical rotation of the blade assembly 22. Thus, vertical movement of blade assembly 22 occurs through swivel connection 97 on the blade assembly itself and swivel connection 90 on vertical side member 60.

Figure 4:
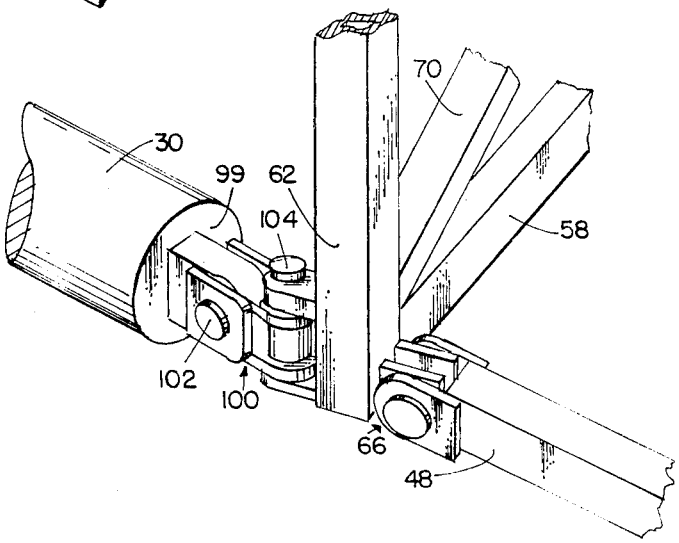
FIG. 4 is an enlarged perspective view showing another portion of the apparatus of FIG. 2.

Also as discussed briefly above, hydraulic cylinder 30, which is similar to hydraulic cylinder 28, is partially responsible for control of the movement of blade assembly 22. Hydraulic cylinder 30 extends between vertical side frame member 62 at the lower end thereof and blade assembly 22 at a point approximately midlength thereof, in the vicinity of swivel connection 97 for hydraulic cylinder 28. FIGS. 4 and 5 show the details of the two connections.

Referring to FIG. 4, one end 99 of hydraulic cylinder 30 is connected to vertical side frame member 62 by means of a swivel connection 100. Swivel connection 100 includes a horizontal swivel element or pin 102 and a vertical swivel element or pin 104. Hydraulic cylinder 30 is thus free to rotate vertically about pin 102 and horizontally about pin 104.

Referring to FIG. 5, the extending arm 106 of hydraulic cylinder 30 is connected to a swivel connection 108 which includes a horizontal swivel pin 110. This arrangement permits vertical rotation of the hydraulic cylinder relative to the blade assembly 22 and hence movement in the vertical direction with the extending arm 106 of hydraulic cylinder 30 as hydraulic cylinder 30 rotates about swivel connection 100.

Swivel connection 108 is secured to the upper plate of a two plate turntable 112. The lower plate of the two-plate turntable 112 is secured to a platform 114 which in turn is secured, such as by welding, to the reinforcing bar 32 attached to the rear of the blade 23. The combination of swivel connection 100 at one end of hydraulic cylinder 30 and swivel connection 108 and turntable 112 at the other end permits a wide range of controlled movement of blade assembly 22.

In operation, hydraulic cylinder 30 controls movement of the blade assembly 22 in a horizontal plane about turntable element 26 and turntable 112, while hydraulic cylinder 28 controls the vertical position of the blade 22 about pivot connector 27 and swivel connection 97. This arrangement permits a range of movement of the blade assembly 22 over an angle of approximately 90° in the horizontal direction and a range of movement of approximately 60° in the vertical direction. The position of the blade assembly 22 is to an extent determined by the position of support frame 20, as the support frame is capable of moving through an angle of 80°–90° in the vertical plane.

Figure 8:
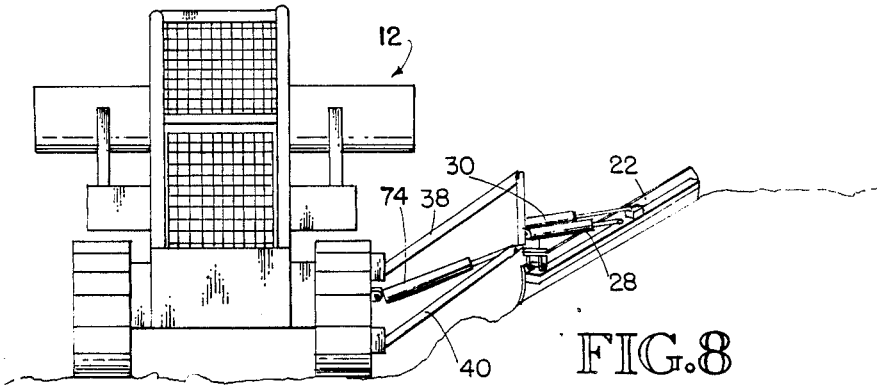
FIG. 8 is a rear elevational view showing the vehicle of FIG. 1 with the apparatus of the present invention operating on a side cut.

FIGS. 6 and 7 show the partial range of movement of the blade of the present invention relative to the vehicle 12. In FIG. 6, the connecting frame 54 is shown in a vertical position which is approximately 15° above a horizontal base line, through pivot point 47 on the vehicle, while the blade is approximately 30° above the horizontal. This permits the cutting and cleaning of a slope which is slightly above the horizontal. FIG. 8 shows the vehicle with the blade of the present invention accomplishing such a result.

FIG. 7 shows a slightly different arrangement, in which the support frame 54 is oriented at an angle approximately 15° below the horizontal base line, and the blade assembly 22 is oriented at an angle of 25° or so below the horizontal. This permits the cutting or cleaning of a trench or ditch from above, which cannot be done with known blade attachments.

It should be understood that the apparatus described is capable of a wider range of movement than is shown in FIGS. 6 and 7, both with respect to the support frame 54 and the blade assembly 22. The range of movement includes the blade assembly 22 being positioned so as to extend well above the top of the vehicle, and in a substantially vertical orientation. The blade assembly 22 may be also made to extend even further upward by adding extensions onto the upper end thereof. The blade assembly 22 may also be positioned at a greater downward angle (below the horizontal) than shown in FIG. 7, as can the frame 20. The blade assembly 22 thus can be positioned to reach a significant distance below the vehicle.

Also, the blade assembly 22 may be moved horizontally through an angle which is not shown specifically in FIGS. 6 or 7 but which is illustrated in FIG. 2, and in the embodiment shown is approximately 90°.

Although the blade apparatus of the present invention is particularly suited for tracked vehicles, such as shown in FIGS. 1 and 8, it is also suitable for other earth moving vehicles such as graders and the like, typically extending from a base position at the sides of those vehicles.

The blade apparatus adds significantly to the capability of earth moving equipment at a relatively small cost compared to the overall expense of the equipment. It encompasses a broad range of capabilities and functions and hence is very versatile in operation.

Although a preferred embodiment of the invention has been disclosed herein for illustration, it should be understood that various changes, modifications and substitutions may be incorporated in such embodiment without departing from the spirit of the invention which is defined by the claims which follow.

I claim:

1. An adjustable blade apparatus for use with an earth moving vehicle, such as a bulldozer or the like, comprising:

a support assembly, including a connecting frame member, supported relative to the vehicle such that the connecting frame is movable as a unit in a single vertical plane when the vehicle is in a horizontal position;

an earth moving blade movably secured to the connecting frame;

means independent of the earth moving blade for moving the connecting frame in said vertical plane without changing the orientation, other than the vertical position, of the earth moving blade secured thereto;

means independent of the connecting frame moving means for moving the earth moving blade relative to the connecting frame, wherein said blade moving means includes means for moving the blade in a first plane relative to the connecting frame member and a second plane which is at right angles to the first plane, wherein the blade is rotatably connected in the vicinity of one end thereof to the connecting frame member and wherein said means for moving the blade in a first plane includes a first hydraulic cylinder connected between the connecting frame member at a point substantially removed from the rotatable connection of the blade element and the blade at a selected point substantially removed from the one end thereof, and wherein the blade is pivotably connected in the vicinity of said one end thereof to the connecting frame member in the immediate vicinity of the rotatable connection thereof, and wherein the means for moving the blade in a second plane includes a second hydraulic cylinder connected between the connecting frame member in the vicinity of the pivotable connection of the blade and thereto and the blade at a point substantially removed from the one end thereof.

2. An apparatus of claim 1, wherein the support assembly includes a plurality of elongated arms connecting the connecting frame member to support points on the vehicle, wherein each elongated arm includes pivoting connections both at the support points and at the connecting frame member.

3. An apparatus of claim 2, wherein the elongated arms are pivotably secured to the support points and the connecting frame member in such a manner as to permit the connecting frame to move through a substantial distance in said vertical plane.

4. An apparatus of claim 3, wherein the connecting frame member is rectangular in outline and substantially flat, wherein one of said plurality of elongated arms extends between each corner of the connecting frame and one of the support points on the vehicle, and wherein the blade is rotatably and pivotally connected to the connecting frame member at a lower corner thereof.

5. An apparatus of claim 3, wherein the connecting frame moving means includes a third hydraulic cylinder connected directly between the vehicle and the connecting frame member, and further includes means for controlling the action of the third hydraulic cylinder such that operation thereof results in vertical movement of the entire support assembly.

6. An apparatus of claim 1, wherein the blade is adapted to receive an extension, which increases the total length of the blade.

7. An apparatus of claim 1, including swivel connectors at both ends of the first hydraulic cylinder, for connection with the connecting frame member and the blade, respectively.

8. An apparatus of claim 7, wherein the rotatable connection is a turntable element.

9. An apparatus of claim 1, including swivel connectors at both ends of the second hydraulic cylinder, for connection with the connecting frame member and the blade, respectively.

* * * * *